United States Patent [19]

Fala et al.

[11] Patent Number: 4,991,488

[45] Date of Patent: Feb. 12, 1991

[54] ACOUSTIC DETECTION OF NOTE BENDING IN STRINGED M.I.D.I. COMPATIBLE MUSICAL INSTRUMENTS

[76] Inventors: Joseph M. Fala, 3885 Canfield Rd., Pasadena, Calif. 91006; Ajay K. Keshap, 14339 Tiara #7, Van Nuys, Calif. 91401; Mark S. Doerning, 947 Balboa Dr.; Jay T. Barbeau, 5200 GaryPark Ave., both of Arcadia, Calif. 91006

[21] Appl. No.: 474,656

[22] Filed: Feb. 2, 1990

Related U.S. Application Data

[60] Continuation of Ser. No. 231,271, Aug. 12, 1988, abandoned, which is a division of Ser. No. 1,646, Jan. 9, 1987.

[51] Int. Cl.[5] ..... G10H 3/18

[52] U.S. Cl. ..... 84/731; 84/DIG. 24; 84/DIG. 30

[58] Field of Search ..... 84/723-746, 84/DIG. 24, DIG. 30, 267

[56] References Cited

U.S. PATENT DOCUMENTS

| | | | |
|---|---|---|---|
| 4,653,376 | 3/1987 | Allured et al. | 84/1.16 |
| 4,723,468 | 2/1988 | Takabayashi et al. | 84/1.16 |
| 4,873,904 | 10/1989 | Norimatsu | 84/727 X |

*Primary Examiner*—Stanley J. Witkowski

*Attorney, Agent, or Firm*—Natan Epstein; William H. Pavitt, Jr.

[57] ABSTRACT

Note bending in a MIDI interfaceable fretted string instrument is detected by sensing relative phase shifting in an echo return of an ultrasonic acoustic signal propagated along each string. The delay between the propagated signal and echo return is indicative of the musical note obtainable by playing the string. The propagation and sensing may be accomplished by means of a single piezoelectric transducer coupled to each string, and the same transducer can sense string vibration in the audible frequency range indicative of the timing and amplitude of a musical note played on the string.

15 Claims, 12 Drawing Sheets

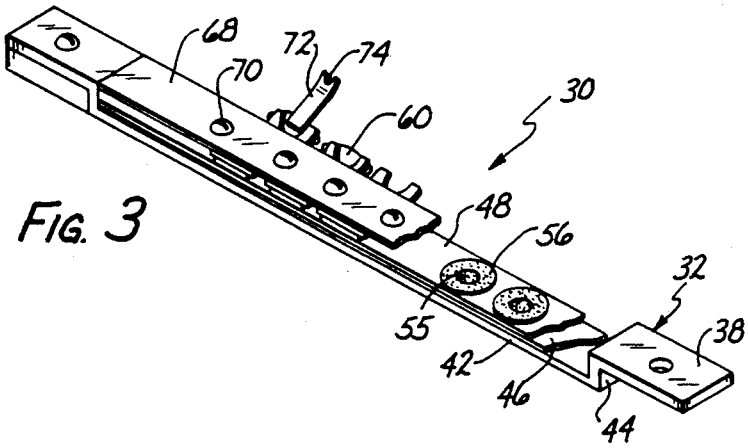
FIG. 3
FIG. 7
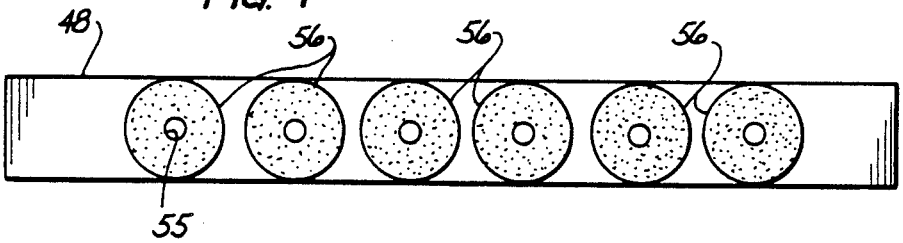
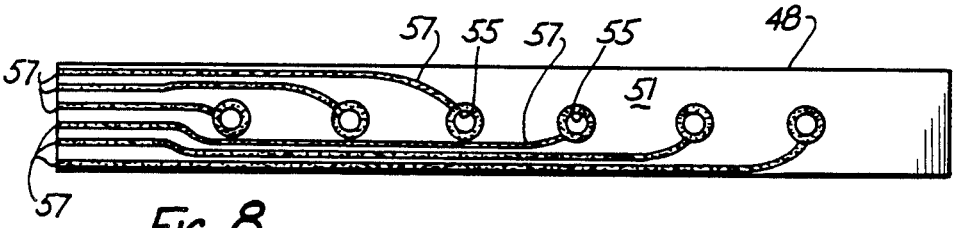
FIG. 8
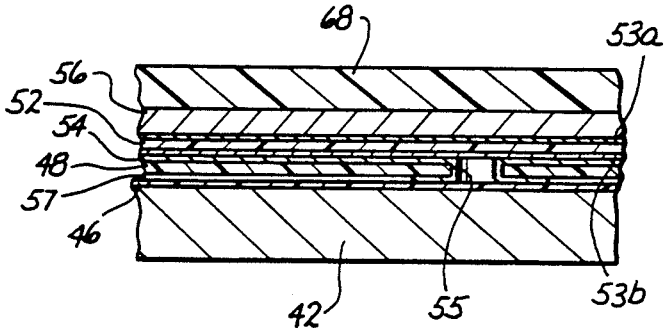
FIG. 9

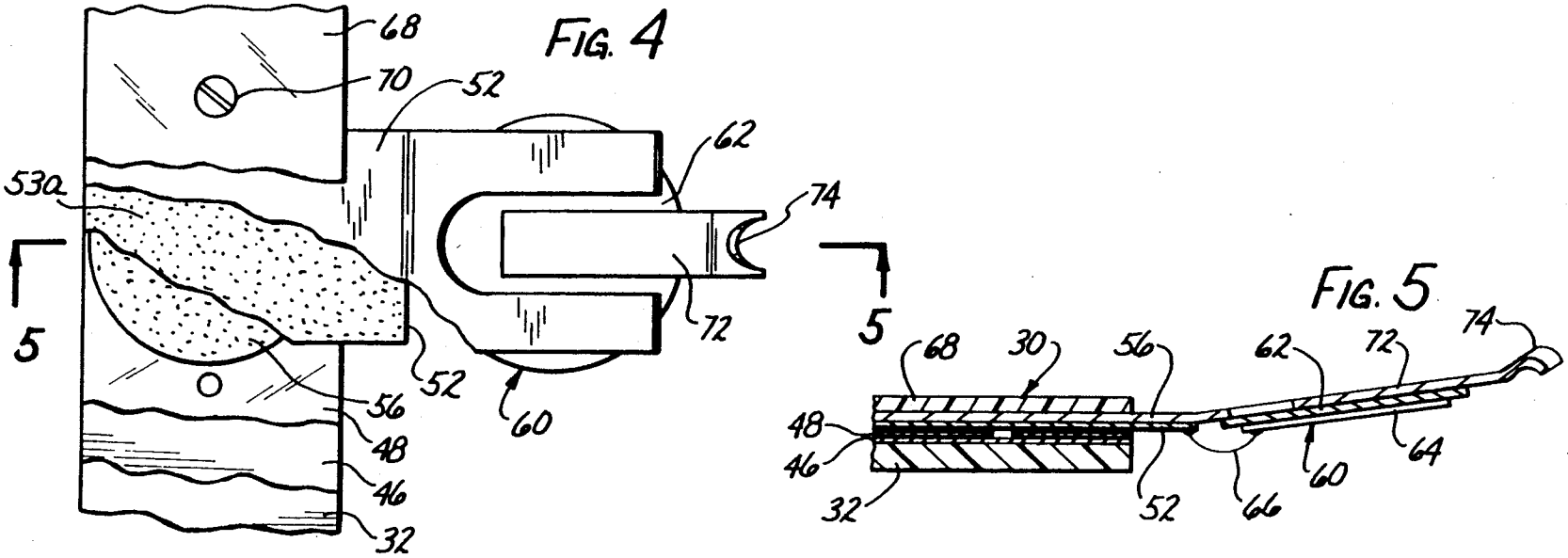
FIG. 4
74
62
72
60
52
68
70
56
48
46
32
53a
5
FIG. 5
74
64
72
60
62
66
56
52
30
68
5
48
46
32
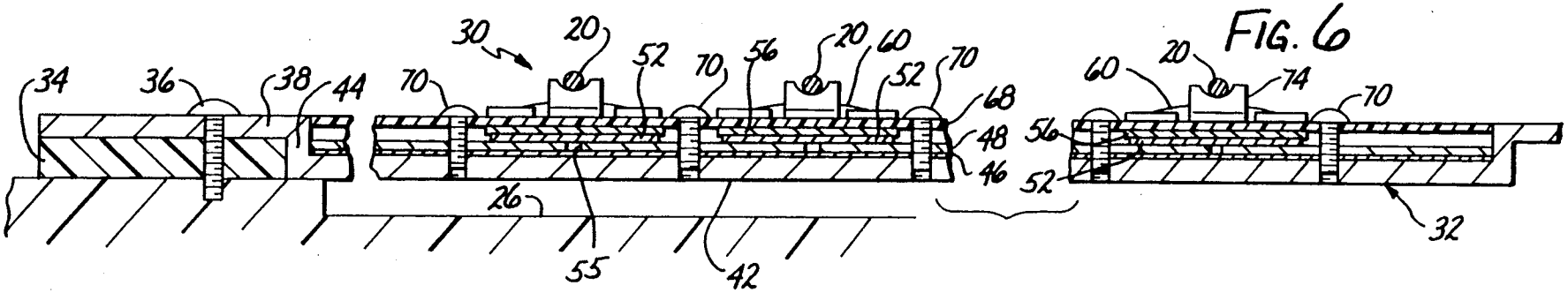
FIG. 6
32
70
74
20
60
56
52
68
48
46
70
52
60
20
56
42
70
52
20
55
30
26
70
44
38
36
34

FROM μP
+5V
CLK
GATED
8253
TO μP DATA BUS
110

CLEAR PEAK
88
102
104
106
108
100
10K
914
98
.01μf
3.3K
96
.1μf
390Ω
1000pf
94
51K
15K
100pf
12K
1N914
92
20K
IN FROM BUFFER 80

OUTPUT 1
OUTPUT 2
88
STRING LENGTH DETECTOR
NOTE LEVEL DETECTOR
90
BUFFER AMPLIFIER
80
84
DRIVE OSC.
82
SWITCH CONTROLLER
86
STRING TRANSDUCER
60

CLEAR PEAK DETECTOR 1
SERIAL
MIDI OUT
120
UART
μP
CLEAR PEAK DETECTOR 2
130
μP DATA BUS
TOGGLE SWITCH
CLEAR
BINARY COUNTER
RESET
110
OUT
128
A/D
108
CLOCK IN
C1
C2
C3
102
104
106
126
STRING SELECT DEMUX
98 PEAK DETECTOR 1
DIFFERENTIATOR
96
LOW PASS
94
RECTIFIER
92
BUFFER
80
82
60
88
PEAK DETECTOR 2
124
2KHZ
122
LOW PASS
90
PEAK DETECTOR 1
98
DIFFERENTIATOR
96
LOW PASS
94
RECTIFIER
92
BUFFER
80
82
60
e
E
d
D
c
C
B
A
40 KHZ TEST SIGNAL
40 KHZ ECHO SIGNAL
P'
C
A2
P
C
A1

ACOUSTIC DETECTION OF NOTE BENDING IN STRINGED M.I.D.I. COMPATIBLE MUSICAL INSTRUMENTS

This is a continuation of application Ser. No. 231,271 filed Aug. 12, 1988 and now abandoned which application is a divisional application of Ser. No. 07/001,646 filed Jan. 9, 1987, now pending.

BACKGROUND OF THE INVENTION

1. Field of the Invention

The present invention pertains generally to the field of electronic musical instruments and is more particularly directed to a novel sound pick-up for string instruments and associated electronic circuits for encoding the pick-up output in M.I.D.I. compatible serial digital format for driving a sound synthesizer or other sound processing system equipped with a standard M.I.D.I. interface.

2. State of the Prior Art

Sound or music synthesizers have come into widespread use and are available from a growing number of manufacturers. While the various models currently offered differ in terms of capability flexibility and complexity many are equipped with a M.I.D.I. (Musical Instrument Digital Interface) interface, a unified data communication standard for electronic musical intruments which enables systems of different manufacture to be used together. For example two or more synthesizers of different make may be simultaneously controlled or played from a single keyboard.

At present, the keyboard remains the most commonly used input device to MIDI sound synthesizers. However, many performers and musicians are more proficient with or have a preference for non-keyboard musical instruments, particularly among the great numbers of guitar players. A need therefore exists for MIDI interfaceable string instruments and more precisely, for sound pick-up systems for musical string instruments having a MIDI compatible output.

U.S. Pat. No. 4,606,255 issued Aug. 19, 1986 to Hayashi et al. and other patents cited therein, particularly U.S. Pat. No. 4,357,852 issued Nov. 9, 1982 to Suenaga, are directed to guitars for use with a sound synthesizer. These guitars derive an input signal to the synthesizer by detecting the fundamental frequency of a vibrating guitar string. This requires that the guitar pick-up be connected to circuits capable of accurately discriminating between the fundamental and the multiple harmonic frequencies simultaneously generated when any of the guitar strings is played. In practice however, it happens under certain circumstances that the system erroneously identifies a harmonic frequency as the fundamental, and thus causes the sound synthesizer to generate an output note other than the one actually played by the performer. In addition, the currently available MIDI guitar sound pick-up systems are excessively costly and not widely affordable.

A continuing need therefore exists for more reliable and lower cost MIDI interfaceable pick-up systems for musical string instruments.

SUMMARY OF THE INVENTION

This invention advances the state of the art by providing a sound pick-up system based on a novel method of sensing a musical note played on a string of a musical instrument. A test signal is applied by a transmitter to one fixed end of the string and propagates along the string towards the opposite end of the string. Upon reaching the opposite end or an arbitrary intermediate point of the string which has been clamped against vibration, a return signal or echo results from reflection of the test signal which return signal is detected by a receiver. A selected characteristic of the propagated and return signals are compared by a string length detection circuit which derives a first output representative of the physical length of the string between the propagation end and the reflection point of the signal, which first output is therefore also indicative of the fundamental frequency of vibration of the string and thus of the musical note obtainable by playing the string. A level sensing circuit monitors the string for acoustic vibration induced by a player touching the string to elicit a musical note and upon sensing such vibration a second electrical output is derived indicative of the intensity of such sensed vibration and thus representative of the level of the musical note played. The playing of a note on the string may be sensed either in a normal mode by detection of a note level output exceeding a preset level or in a fret trigger mode upon sensing a change in the string length irrespective of any note level output.

The first and second electrical outputs thus derived may be used in their original form for driving other systems or may be encoded in any suitable format for input to a sound synthesizer or other sound processing system. In particular, the first and second outputs of the sound pickup may be operated on by a suitably programmed microprocessor and encoded for system output in M.I.D.I compatible serial digital format for input to a standard M.I.D.I. synthesizer.

The pick-up system of this invention may also be configured for detecting a relative phase shift in the return signal which has been found to occur due to bending of the string by the player of the instrument while holding a particular note, and deriving a third electrical output related to such phase shift and thus indicative of the degree of string bending. This third output may also be encoded in a manner similar to that of the first and second outputs for input to a sound synthesizer or other system.

The test signal propagated along the string may be an acoustic wave of a frequency which preferably lies outside the normal tonal range of the instrument, as for example, an ultrasonic frequency. The test signal is generated by a transmitter circuit and applied to the string by means of a suitable transducer driven by the transmitter and coupled to the string. The return signal is detected by a receiver circuit which may advantageously share the same transducer with the transmitter circuit. In the case of an ultrasonic test signal, the transducer may be a piezo-electric transducer mechanically coupled to the string.

In a presently preferred form of the invention, the test signal is intermittently applied to the string and the string length or first output is derived from a measurement of the time lapse between propagation of the test signal and detection of the return echo. In alternate forms of the invention however, the test signal may be propagated continuously and the first electrical output derived from the phase relationship between the return echo and propagated test signals. String length information may be derived in still other ways, as for example, by periodically applying a sweep frequency signal to the string, the signal being of either acoustical or electrical nature, receiving a return sweep signal reflected from the opposite end of the string, and then operating on the relationship between the transmitted and returned signals at various discrete frequencies in a manner known in the art to derive the first electrical output. Furthermore, the acoustic test signal may be propagated by mechanically coupling a suitable transducer to the string or alternatively by inductive coupling of an electromagnetic transducer.

In general, the present invention broadly contemplates that string length information is to be derived from information provided by a transmitted and a reflected signal propagated along the string of the musical instrument The string length output will normally be updated at a string length sampling rate much greater than the rate at which a player is capable of producing different notes on the instrument string, as for example, by touching the string to different frets on a guitar. The string is also monitored for acoustic vibration at a frequency within its normal tonal range. In the normal mode a "note on" output signal is triggered to the MIDI if such string vibration is detected above a preset level. In an alternative fret trigger mode MIDI "note on" output is triggered upon sensing a change in string length irrespective of other vibration of the string. MIDI "note off" output is triggered in either mode by a change in the string length output of the pick-up.

In a system configured for sensing relative phase shift of the return signal indicative of string bending, as will normally be desirable, the microprocessor programmed for encoding the first, second and third pick-up outputs to MIDI format is set to sample the three outputs at a cyclic rate, each cycle producing a MIDI output frame. In any given frame, only two pick-up output conditions can hold true: a new note has been played, in which case a "note off" command is issued terminating the previously played note followed by a "note on" command initiating a new note, or no new note is sensed by the pick-up, in which case only a MIDI string bend command is issued to the synthesizer without turning off the note currently being played, if any.

These and other features and advantages of this invention will be better understood from the following detailed description of the preferred embodiment considered with reference to the accompanying drawings, describing and illustrating a MIDI compatible sound pick-up system for guitar.

BRIEF DESCRIPTION OF THE DRAWINGS

FIG. 3 is a perspective view partly broken away of the piezo-electric transducer pick-up unit mounted to the guitar of FIG. 1;

FIG. 4 is a top plan view of a segment of the pick-up unit of FIG. 3 comprising a single piezo-electric transducer element;

FIG. 5 is a section taken in elevation along line 5—5 in FIG. 4;

FIG. 6 is a longitudinal section taken in elevation of the pick-up unit taken along line 6—6 in FIG. 3;

FIG. 7 shows the top of the printed circuit bridge strip of the pick-up unit of FIG. 3

FIG. 8 shows the underside of the printed circuit bridge strip of the pick-up unit of FIG. 3;

FIG. 9 is an enlarged fragmentary cross-section in elevation showing the stacked elements making up the pick-up bridge;

DETAILED DESCRIPTION OF THE PREFERRED EMBODIMENTS

Figure 1:
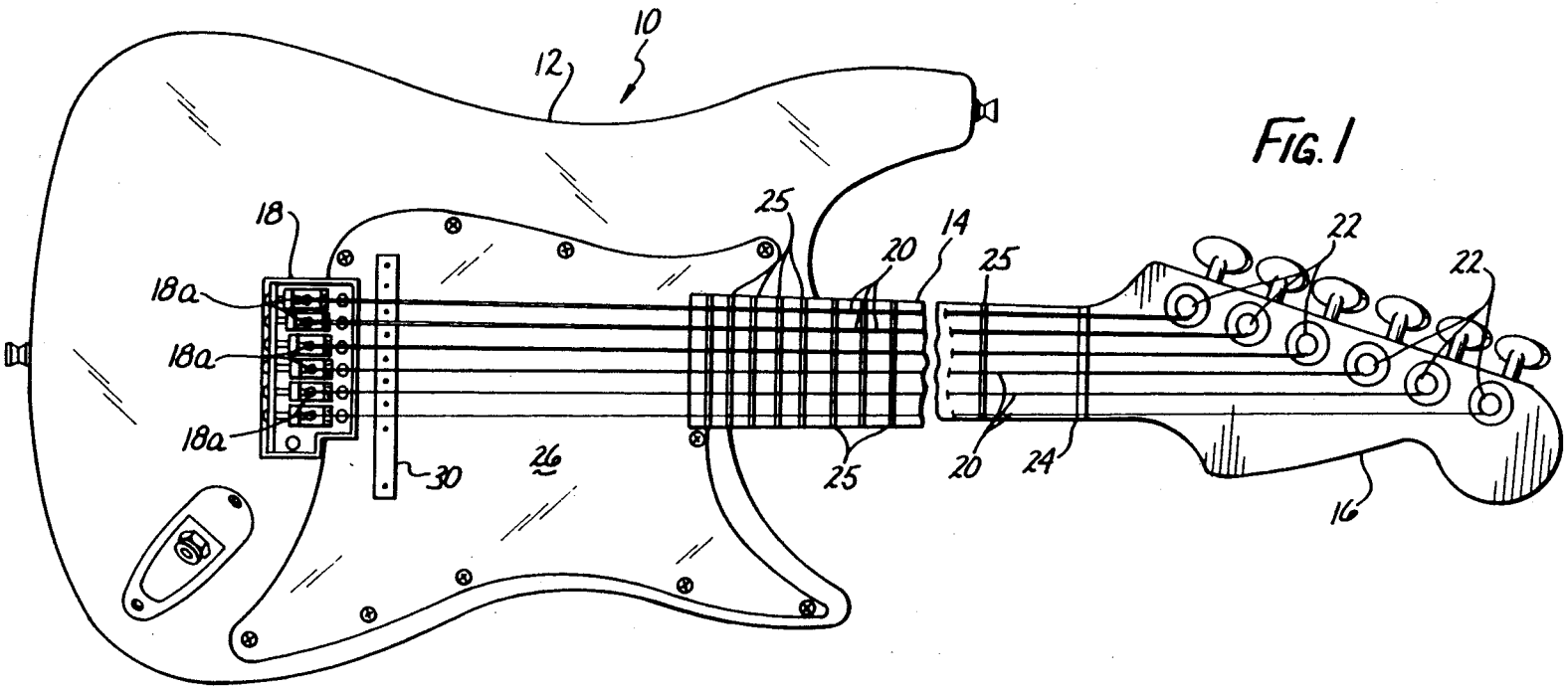
FIG. 1 is a top plan view of a typical guitar equipped with a M.I.D.I. interfaceable sound pick-up system of this invention.
Figure 2:
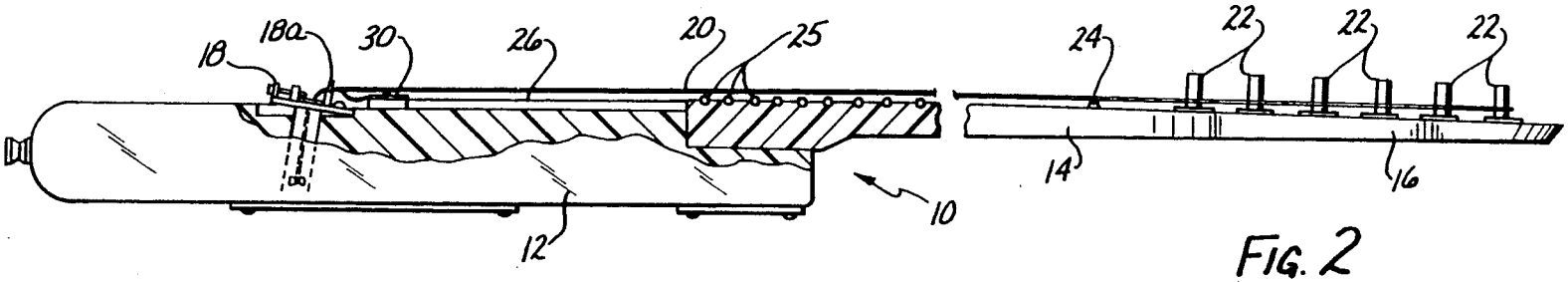
FIG. 2 is a side view of the guitar of FIG. 1.

FIG. 1 shows a typical guitar 10 comprising a guitar body 12 from which extends a guitar neck 14 terminating in a head 16. A string bridge 18 of conventional construction is affixed to the guitar body, and six guitar strings 20 are strung between the bridge 18 and individual tuning pegs 22 mounted to the head 16 for stretching the strings to a desired degree of tautness, thus tuning the strings to acoustically vibrate and give off a desired scale of musical notes according to the physical characteristics of each string, particularly the string length. The tuning pegs and head assembly is constructed in such a manner that all strings 20 are bent over and clamped against a nut bar 24, but spaced above a series of frets 25 as best appreciated by reference to FIG. 2. The strings 20 have an effective acoustic length measured between the bridge anchor points **18*a* of each string and the nut bar 24. The six strings 20 thus lie in a common plane generally parallel to and spaced from an guitar body upper surface 26 as shown in FIG. 2**.

The guitar 10 is equipped with a novel sound pick-up unit 30 which includes a transducer bridge assembly mounted to the guitar body 12 underneath the six strings 26 adjacently to the bridge assembly 18.

The construction of the transducer bridge 30 is shown in FIGS. 3-9 where the bridge assembly 30 is seen to have a bridge bracket 32 supported at two opposite ends 38 in spaced relationship to the guitar surface 26 by means of spacer blocks 34, and secured in place by means of two screws 36 threaded through spacers 34 and the bridge bracket 32 into the guitar body. The bridge bracket 32 may conveniently be a strip of sheet metal bent upwardly at each end 38 in the manner illustrated. The intermediate, dropped portion 42 of the bridge bracket extending between the vertical sections 44 holds a transducer assembly which includes an electrical insulator strip 46 covering the upper surface of the bridge section 42, and a printed circuit bridge strip 48 of the double-clad type having top and bottom surfaces 50, 51 respectively. Resting on the upper surface of the printed circuit strip 48 are six elongated printed circuit strips 52 laid transversely to the bridge strip 48 as best seen in FIG. 5. Each strip 52 is also double-clad circuit board having upper and lower conductive surfaces, the lower conductive surfaces of the strip 52 being in electrical contact with individual, electrically mutually insulated conductive pads etched 54 on the upper surface 51 of bridge strip 48. A transducer support arm 56 lies flat on and in electrical contact with the upper conductive surface of each strip 52, and has a short forked end section 58 bent upwardly at an angle relative to the printed circuit strips 52 and the plane of the guitar surface 26. A piezo-electric transducer element 60 is supported on the end 58 of the arm 56. A suitable commercially available piezo-electric transducer element is Panasonic #EFR-TAB 45K1. The transducer 60 consists of a metallic disk 62 on which is permanently mounted a ceramic wafer 64. The steel disk 62 is spot welded to the underside of the forked end 58 of the transducer support and is therefore in electrical contact with the upper conductive surface 53*a* of the printed circuit strip 52. The ceramic wafer 64 is connected by an electrical lead 66 to the conductive underside 53*b* of the support strip 52. The transducer bridge assembly is completed by an electrically conductive clamping strip 68 which extends transversely to the six strips 52 and parallel to the bridge strip 48, and is secured to the bridge bracket 32 by means of seven clamping screws 70 each of which extends through aligned bores in the elements 68, 48, 46 and is threaded into bracket 32 so as to securely hold together the stacked strip elements in positive electrical contact.

A transducer pick-up arm 72 has one end spot welded to the steel disk 62 of each transducer element 60, while the opposite free end 74 of the transducer pick-up arm is forked for receiving between two prongs an overlying guitar string 20 and make light but positive mechanical spring contact with the string at a point adjacent to the string bridge end 18*a*. Both the transducer support arm 56 and the pick-up arm 72 may be fabricated of 0.010 inch thick spring steel and arranged so that the pick-up arm end 74 is urged upwardly against the string.

A plated-through hole 55 connects each contact pad 54 with a corresponding conductor run 57 etched on the underside of printed circuit board strip 48. Six such runs 57 terminate at one edge of the strip from where a connection is made through a multiconductor cable to a connector (not shown) conveniently mounted on the guitar body. A ground connection is made to the bridge clamp 68 or other convenient point which is electrically common to all steel discs of the six transducer elements 60.

Figure 10:
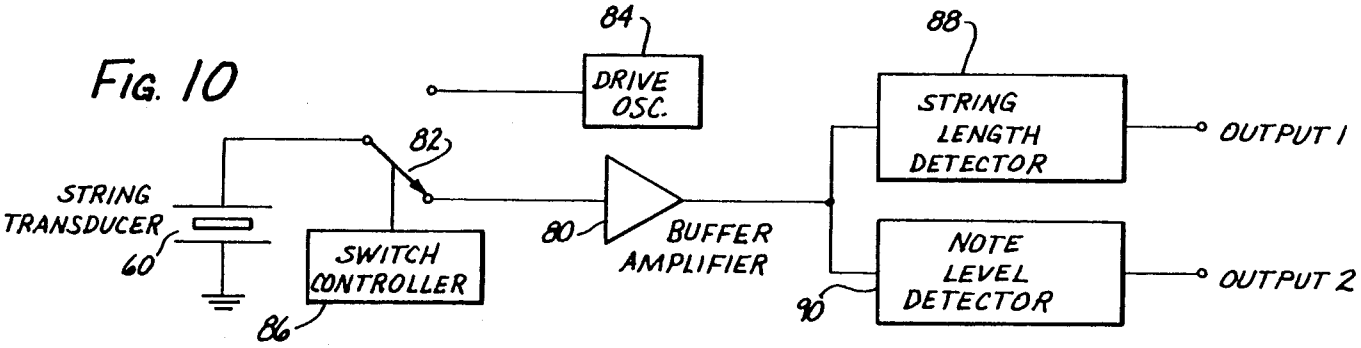
FIG. 10 is a basic circuit block diagram of a single string transmitter receiver channel providing string length and note level outputs for further processing or encoding.

Turning now to the block diagram in FIG. 10, each string transducer element 60 is electrically connected to the input of a high impedance current buffer amplifier stage 80 through an analog switch 82. A transducer drive circuit such as an oscillator 84, generates a waveform of ultrasonic frequency such as the 40 Khz waveform illustrated in FIG. 12 which is applied as the test signal to each guitar string 20 through the transducers 60. The test signal in the system being here described is generated by a system microprocessor. The switch 82 is toggled by a switch controller 86, which in the present system is also included in the system microprocessor, for alternately switching the transducer 60 between the output of drive oscillator 84 and the input of buffer amplifier 80. In an initial condition, the switch 82 is connected for applying the output of the oscillator 84 to the transducer 60 which causes an ultrasonic test signal to be mechanically applied to a guitar string 20 at the bridge end 18*a* of the string. The applied test signal acoustically propagates along the string 20 towards the head end of the string which for acoustic purposes is at the contact point with the nut bar 34, assuming the string is open i.e. is not being pressed down against the guitar neck at any fret 25 or other point intermediate to the open string ends. The acoustic test signal wave is reflected at the nut bar 24 and returns along the string 20 back towards the bridge end 18*a* where the signal is sensed and converted from mechanical to electrical form by transducer 60.

The switch 82 is toggled between the output of oscillator 84 and the input buffer stage 80 at a fast enough rate such that the return or echo signal sensed by transducer 60 is fed to the input of buffer stage 80 which in turn provides an input signal to two receiver sections operating in parallel, namely a string length detector circuit 88 which derives a first output indicative of the current acoustic length of the guitar string 20 associated with the particular string transducer 60, and a note level detector 90 which derives a second output indicative of acoustic vibration of the guitar string at frequencies other than the ultrasonic frequency output of the transmitter oscillator 84 within the instrument's normal tonal range and in particular acoustic vibration such as produced by a player plucking or strumming the string 20.

The FIG. 10 diagram shows a single channel transmitter/receiver system with a single transducer 60. In a complete six string guitar system such as here described, a separate transducer 60 is coupled to each of the six guitar strings 20 as described in connection with FIGS. 1–9 and each transducer element is driven by a suitable transmitter or oscillator circuit, preferably one which drives all transducers simultaneously in parallel. Likewise, six mutually independent receiver channels such as shown in FIG. 10 and operating in parallel are provided, each receiver channel being associated with one of the string transducers 60, and each receiver channel delivering separate first and second output signals.

Figures 11, 12, 12A:
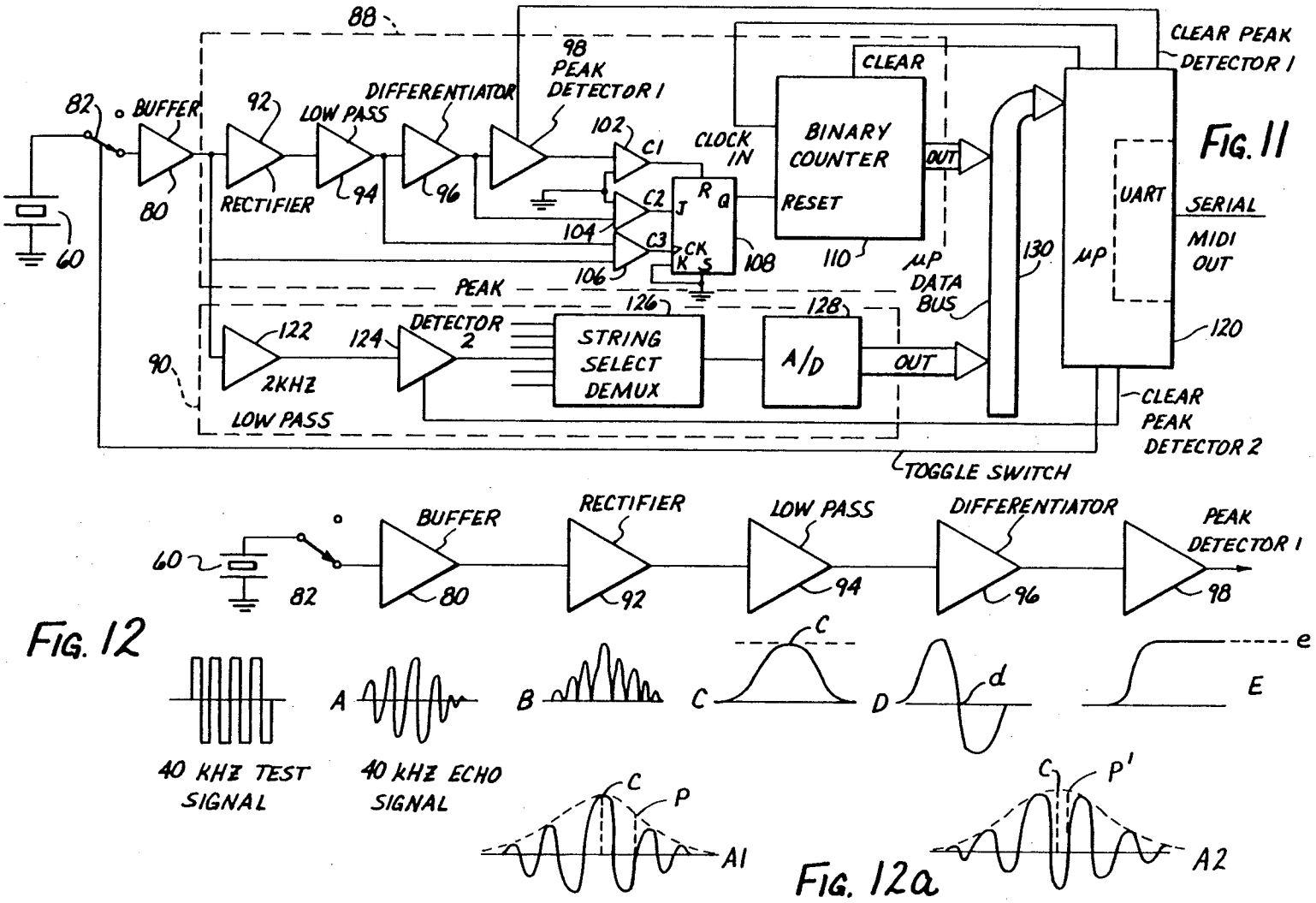
FIG. 11 is a more detailed block diagram of the system with M.I.D.I. output according to this invention, showing a single string channel only for clarity.
FIG. 12 illustrates the waveforms at various stages of the echo receiver front end section for deriving the string length output.

Turning now to FIG. 11, a complete single channel system is shown in more detailed block diagram form and in particular showing the block components of each receiver section 88, 90. The processing of the echo signal to derive string length information is illustrated in FIG. 12. The string length detector section 88 comprises a rectifier stage 92 which receives the 40 kilohertz echo signal output A of buffer stage 80 shown in FIG. 10 and rectifies the waveform A to a rectified waveform B. The rectified output is passed through low pass filter stage 94 which removes the high frequency components of the rectified 40 kilohertz signal and produces an output waveform C which is substantially the envelope of the rectified high frequency signal B. The low pass filter output then is fed to a differentiator stage 96 which operates to produce a differentiated output waveform D wherein the zero voltage crossing point d corresponds to the peak point c in the envelope waveform C. The differentiated output D is then fed to peak detector 98 the output of which is represented by waveform E. The peak level e of the waveform E represents the magnitude of the peak c, i.e. the peak voltage of the return signal A. The receiver front end section 88 is completed by a comparator circuit which includes first, second and third comparators 102, 104 and 106 respectively.

Comparator 102 receives as comparative inputs the outputs of peak detector 98 and differentiator 96 to derive a first comparator output C1 whenever the peak height c exceeds the level e of a previous peak C held by peak detector 98, and whenever this condition occurs, an output pulse is derived by comparator 102 at output C1. This comparison of consecutive peak heights by receiver circuit 88 is a noise discrimination function based on the premise that while various random or non-random noise transients and waveforms may be picked by the transducer 60 and processed by the receiver front end circuit 88, none of the noise waveforms will exceed the peak level c of the test signal echo waveform A.

Figure 13:
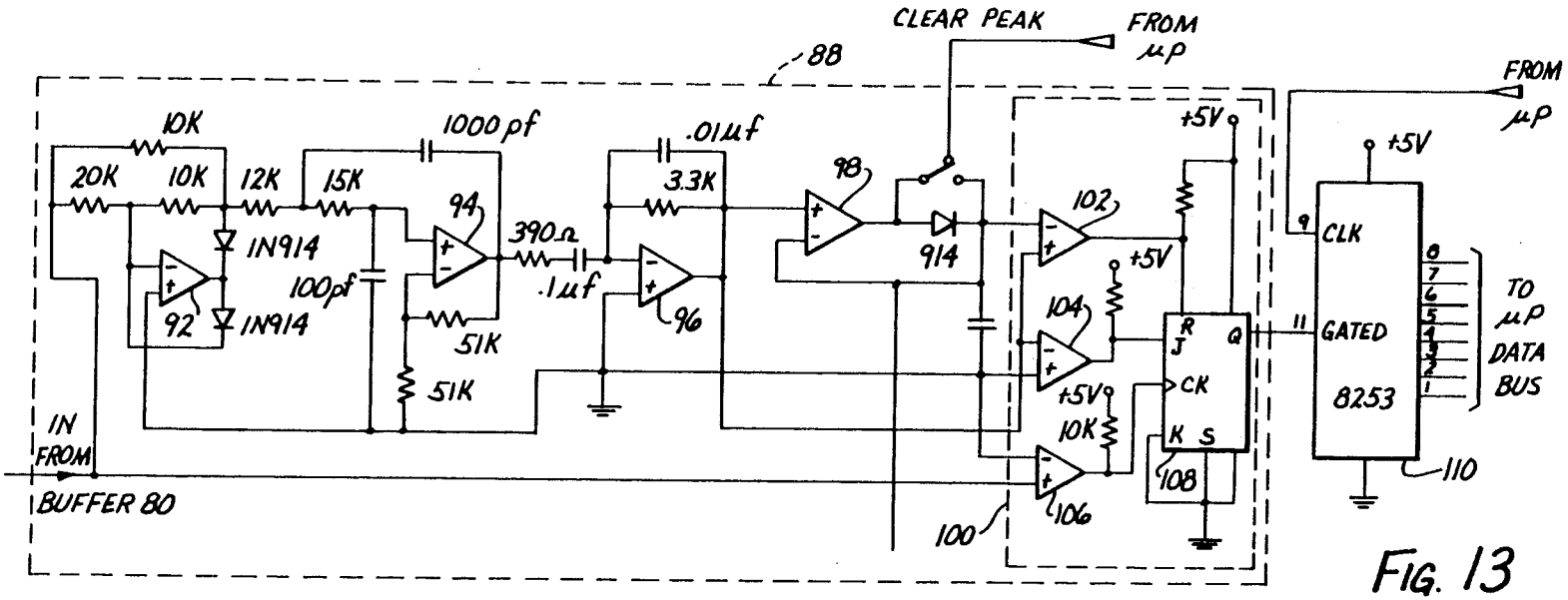
FIG. 13 is a circuit diagram of the receiver front end section of FIG. 12.

Comparator 104 references the output of differentiator 96 against system ground and derives an output pulse at comparator output C2 upon detecting the zero crossing d of the differentiated waveform D. Output C2 therefore provides a precise indication in time of the occurrence of the echo signal peak c. Finally the third comparator 106 references the test signal echo 40 kilohertz signal A to system ground and derives at output C3 a clock pulse at each rising phase edge of the echo waveform A. The three comparator output C1, C2, C3 are inputs to a J-K flip-flop 108. The flip-flop resets at every high peak output C1, is then set by the C2 output indicative of an actual peak occurrence and is triggered by the immediately following phase edge output C3 into the clock input of the flip-flop. When all three conditions required for flip-flop output have been meet by the comparator signals C1, C2, C3, a string length output Q is derived by the flip-flop 108 and is connected as a reset input to a binary counter 110. Counter 110 is continuously clocked from a microprocessor 120 and the binary count output of the counter 110 is reset to zero by every output pulse of flip-flop 108. Therefore, as noise peaks are detected by the receiver circuit 88, the counter is reset by each consecutive noise peak of increasing magnitude until a true echo return signal is detected which will also cause the count 110 to be reset to zero, but no noise peaks subsequent to the true echo return within a given system time frame will again cause the counter to be reset because as has been explained the peak detector output will hold the echo return value as the highest peak value and will not be overridden by any subsequent noise peaks. The true count of the binary counter therefore begins upon being reset by the echo peak c. In a six string instrument six receiver sections 88 are provided each driven by its own buffer 80 and driving a separate binary counter. The binary outputs of the six counters 110 is such a system are read into microprocessor 12: through the processors data bus 130. A circuit diagram for the string length receiver section 88 is shown in FIG. 13.

Simultaneously with the string length signal processing by receiver section 88, a note amplitude output is derived by parallel receiver section 90 which as shown in FIG. 11 comprises a two kilohertz low-pass filter stage 122 which receives its input from the buffer 80 output and operates to remove the high frequency components of any string vibrations sensed by transducer 60, and in particular removing the ultrasonic test signal waveform A processed by receiver section 88. The output of low pass filter 122 therefore contains waveforms representative of acoustic vibrations of guitar string 20 within the audible frequency range such as produced by playing the string to produce a musical note. The filtered note signal is fed to the input of a second peak detector 144, the output of which holds the peak value of the note signal detected during the particular system time frame. This peak value output is fed from each of six receiver (only one receiver channel being shown for clarity in FIG. 11) through a string select demultiplexer 126 to the input of an analog-to-digital converter 128 where the analog value of the peak detector output of each receiver channel is converted to digital form suitable for input to the microprocessor 120 through the microprocessor data bus 130. The output of A/D converter 128 is a note amplitude value representative of the loudness of the musical note played on the guitar string 20 during the particular system time frame.

The microprocessor 120 operates, among other functions, as a timer to clock a system time frame which preferably is approximately 4 milliseconds in length. During each system time frame a test signal burst is applied to the instrument strings, its echo detected by the receivers, and the string length and note level outputs derived. In addition, during a particular time frame or at least before completion of the subsequent time frame, the microprocessor operates on the derived first and second receiver outputs to convert the information to MIDI compatible digital serial output. The system time frames are repeated at a rate sufficiently high so that substantially continuous monitoring of the acoustic state of the instrument strings is achieved. At the end of each time frame the peak detectors 98 and 124 and the binary counter 110 are cleared by the processor 120 and the transmit/receive cycle repeats itself.

The processor 120 controls the operation of the transmitter/receiver system and also effects the data conversion and enconding, all under software control. The sequence of operations performed by the processor 120 will now be described with reference to the flow charts of FIGS. 14 through 19.

PROCESSOR MAIN SEQUENCE

Figure 14:
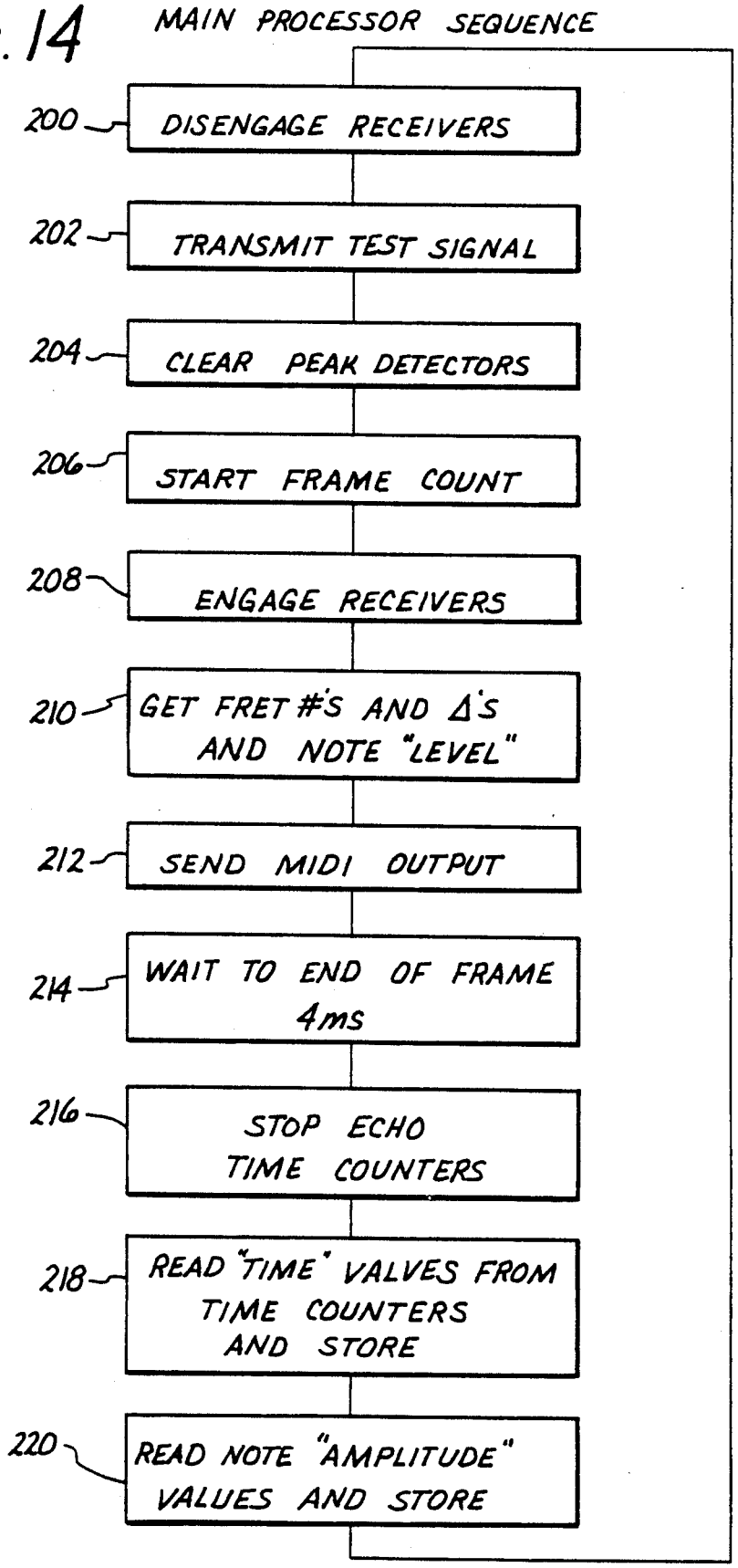
FIG. 14 is a flowchart showing a typical main sequence of operations executed by the microprocessor in the system of FIG. 11 for converting the string length and level outputs to M.I.D.I. formated system output.

The steps in this sequence which is executed once for each system time frame are numbered in parentheses with reference to the numerals in FIG. 14. The microprocessor 120 operates through an output port to toggle the switch 82 which selects the transducer connection between the test signal source 84 in FIG. 10 and the echo receiver circuit. In an initial condition of the system, the microprocessor toggles switch 82 to disengage (200) the receivers and thus transmit (202) a test signal from transmitter 84 through transducer 60 which is propagated along the instrument strings 20. The microprocessor 120 then clears (204) the peak detector 98 and substantially simultaneously starts (206) the four millisecond frame count, immediately thereafter, toggling switch 82 to engage (208) the receiver system i.e. connecting the receivers to the respective transducers. During the time interval while the receivers are waiting for the return echo signal, the processor 120 retrieves (210) certain data, particularly "fret numbers"s, "delta"s and note "level" values, previously stored in memory during one the auxilliary sequences described below for conversion to the desired M.I.D.I. output format and stores these values in the processor's registers. In step 212 the processor performs conversion of the data of the first and second outputs collected during the previous time frame to digital values on scales compatible with command formats understandable by the synthesizer to be driven by the guitar and the output data is encoded in MIDI compatible format and sent out the M.I.D.I. output. The processor then waits (214) to the end of the current four millisecond time frame at which time the processor 120 stops (216) the binary counters 110. The outputs of the binary counters now show a value representative of the time elapsed between detection of the echo return signal and the end of the system time frame. By now subtracting the counter output values, the processor 120 reads (218) the counter output values and subtracts these from the time frame length to derive the actual "time" lapse between transmission of the test signal at the beginning of the time frame and detection of the echo signal during the time frame. This "time" value is stored for subsequent retrieval. The processor then reads and stores (220) the note "amplitude" values at the outputs of the A/D converter 128 for each of the six strings.

The microprocessor 120 also performs a number of subroutines described below in flow chart form, which are auxiliary to the aforedescribed main sequence.

TIME-TO-FRET NUMBER CONVERSION SEQUENCE

Figure 15:
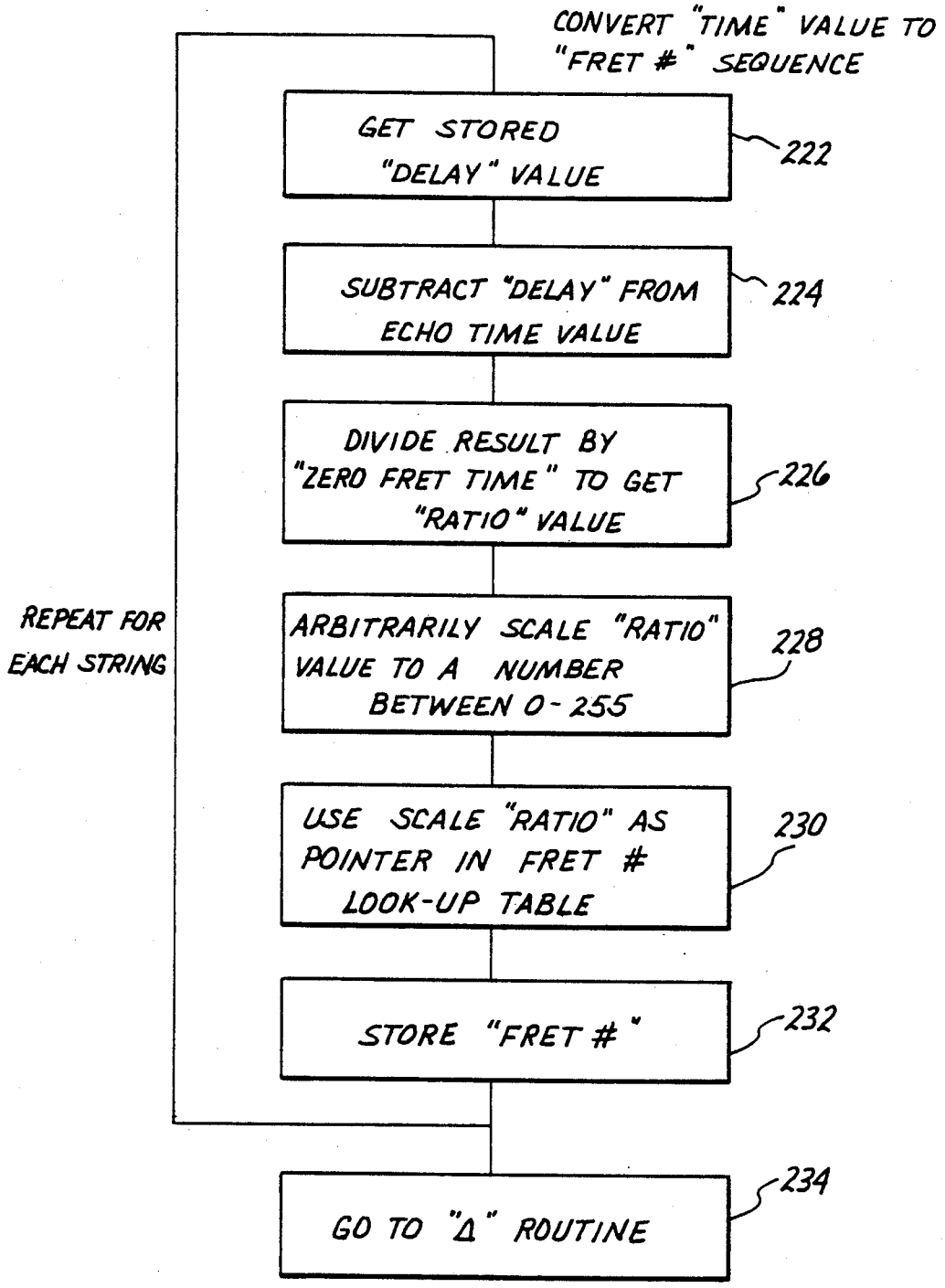
FIG. 15 is a flowchart of an auxilliary microprocessor step sequence for converting the string length output of the receiver to a guitar fret number.

This sequence which is executed once for each string of the instrument, i.e. for each receiver channel of the system, during each system time frame is illustrated in FIG. 15. As a first step the processor retrieves (222) a previously stored "delay" value which is derived and stored during an instrument or tuning or system calibration sequence which is described below. The "delay" value is then substracted (224) from the echo time value stored at step 218 in FIG. 14. The remnant of this subtraction is then divided (226) by a "zero fret time" value, also previously derived and stored in the aforementioned tuning routine the resulting dividend being stored as a "ratio" value. The "ratio" value is then scaled (228) to a number between 0 through 255 according to a preset scale factor which may be user selected. The scaled "ratio" is then used (230) by the processor 120 as a pointer in a stored "fret number" look-up table to find the "fret number" corresponding to the particular echo "time" value. The "fret number" thus obtained is then stored (232) for use in other microprocessor sequences, ending the time to fret number sequence after which the microprocessor may proceed (234) to a string bend value sequence.

STRING BEND VALUES DERIVATION SEQUENCE

Before describing this microprocessor sequence illustrated in FIG. 16, reference is again made to the circuit diagrams of FIGS. 11 12 and 13.

It has been discovered by these applicants, quite surprisingly, that the phase of the echo signal shifts relative to the envelope of the echo signal as a function of string bending by a player while holding a particular musical note. This phenomenon is relied upon in the system of this invention to monitor string bending and derive a string bend output convertible to M.I.D.I compatible data format. This relative phase shift is illustrated in FIG. 13 where the waveform shifts from its zero bend condition at A1 to a bent string condition at A2 relative to the echo signal envelope shown in dotted lining i.e. such that no change in the envelope peak return time occurs. In other words, the relative phase shift is a change in the time difference between the envelope peak c and the next subsequent rising edge of the echo signal A. This "delta" is seen in FIG. 13 as the change along the horizontal time axis between points c and p in waveform A1, and between points c and p' in shifted waveform A2. Point c has not shifted relative to system frame start time; only point p has shifted so that the output of flip-flop 108 is now triggered at point p'. This relative phase shift information is inherently contained in the time value output of binary counter 110 because as earlier described, the count of counter 110 is triggered at the phase edge immediately subsequent to the zero crossing d indicative of the envelope peak. The time value output therefore combines the fret number information with the relative phase shift information. The contribution of the relative phase shift value to the counter output however, is relatively small compared to the numerical magnitude contributed by the fret number information and it is therefore possible to construct a "fret number" look-up table which will accurately permit location of the "fret number" within a "time" value range for each fret of the guitar the range for each number being sufficient to include the maximum possible deviation in time "value" attributable to string bending.

Figure 16:
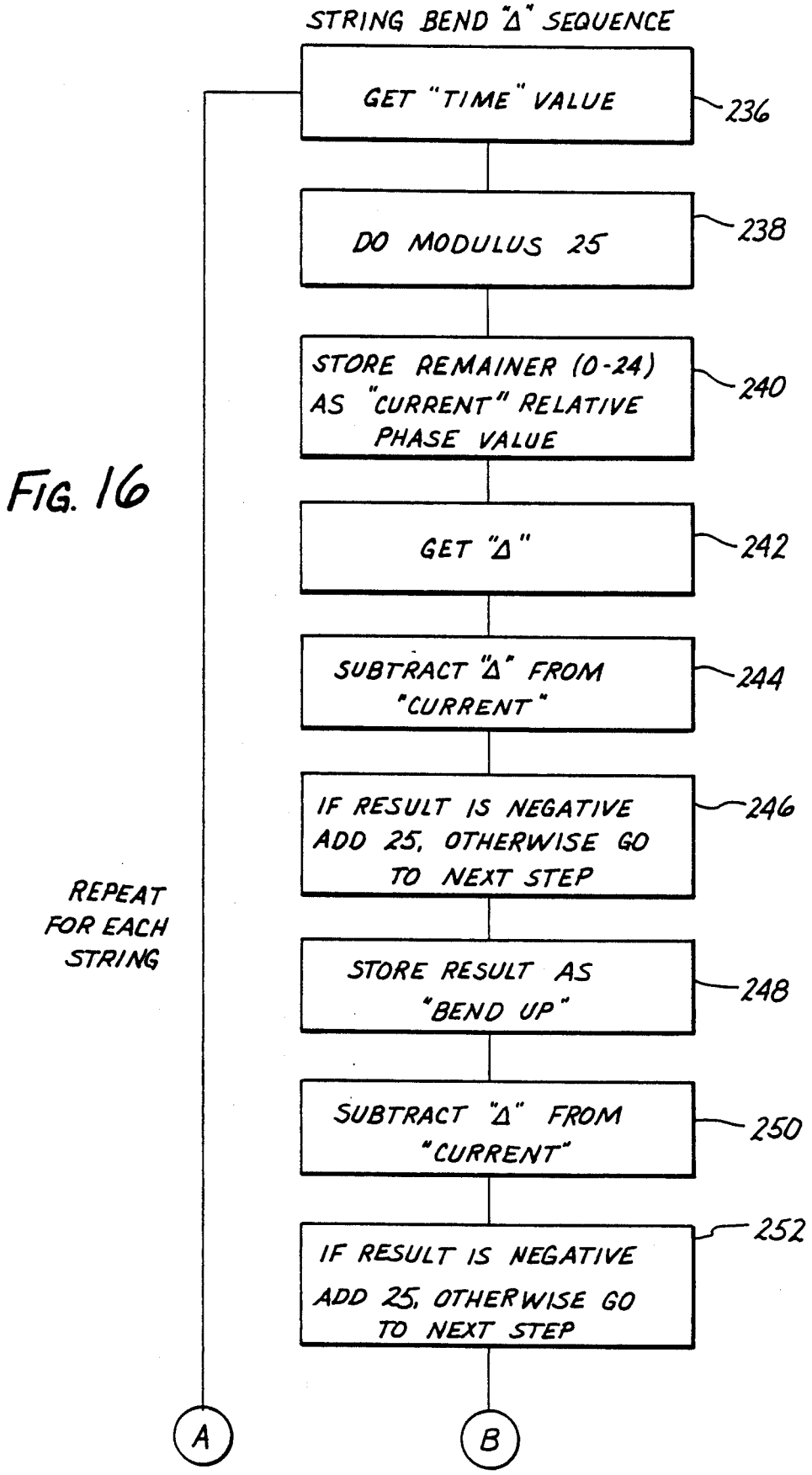
FIG. 16 is a flowchart of an auxilliary microprocessor step sequence for generating the M.I.D.I. formated serial digital system output.
Figure 16:
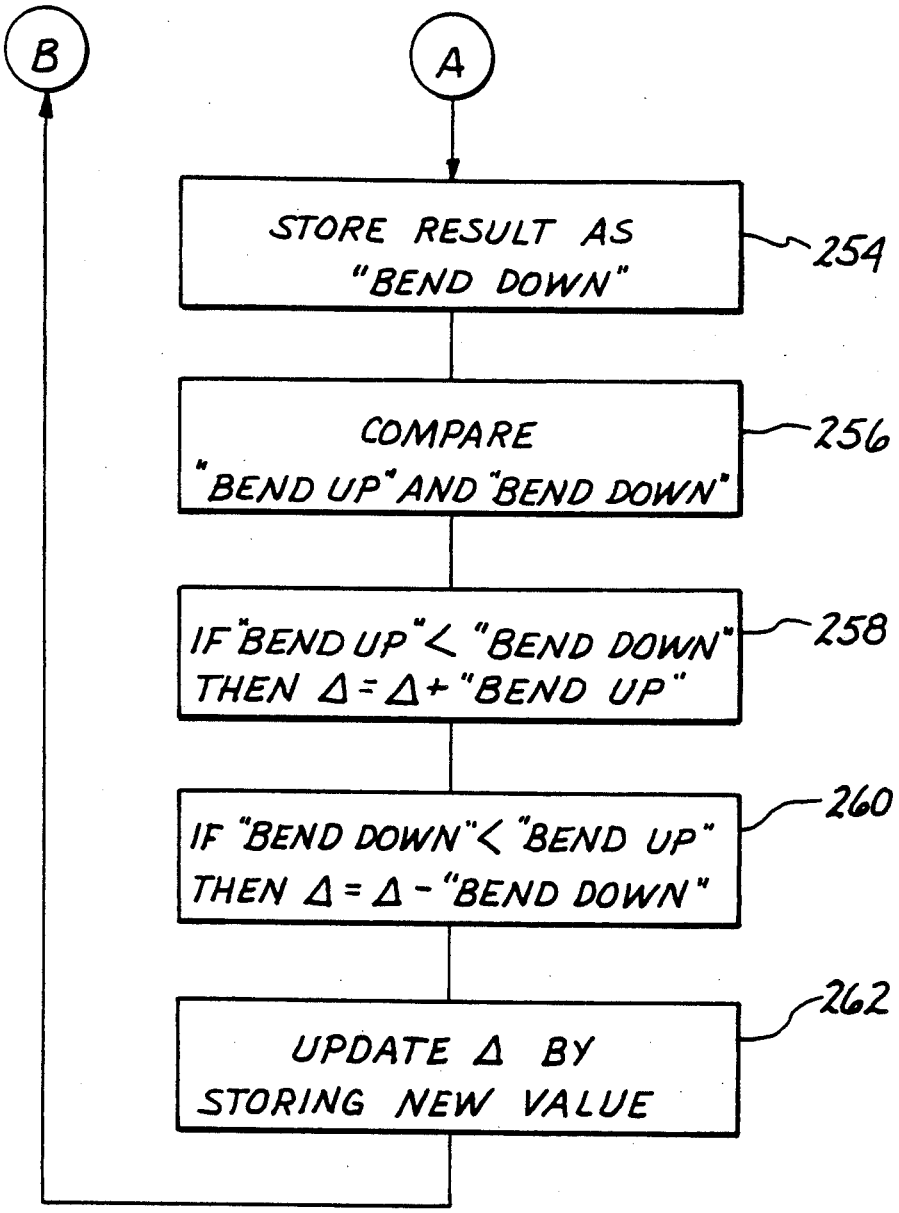
Figure 17:
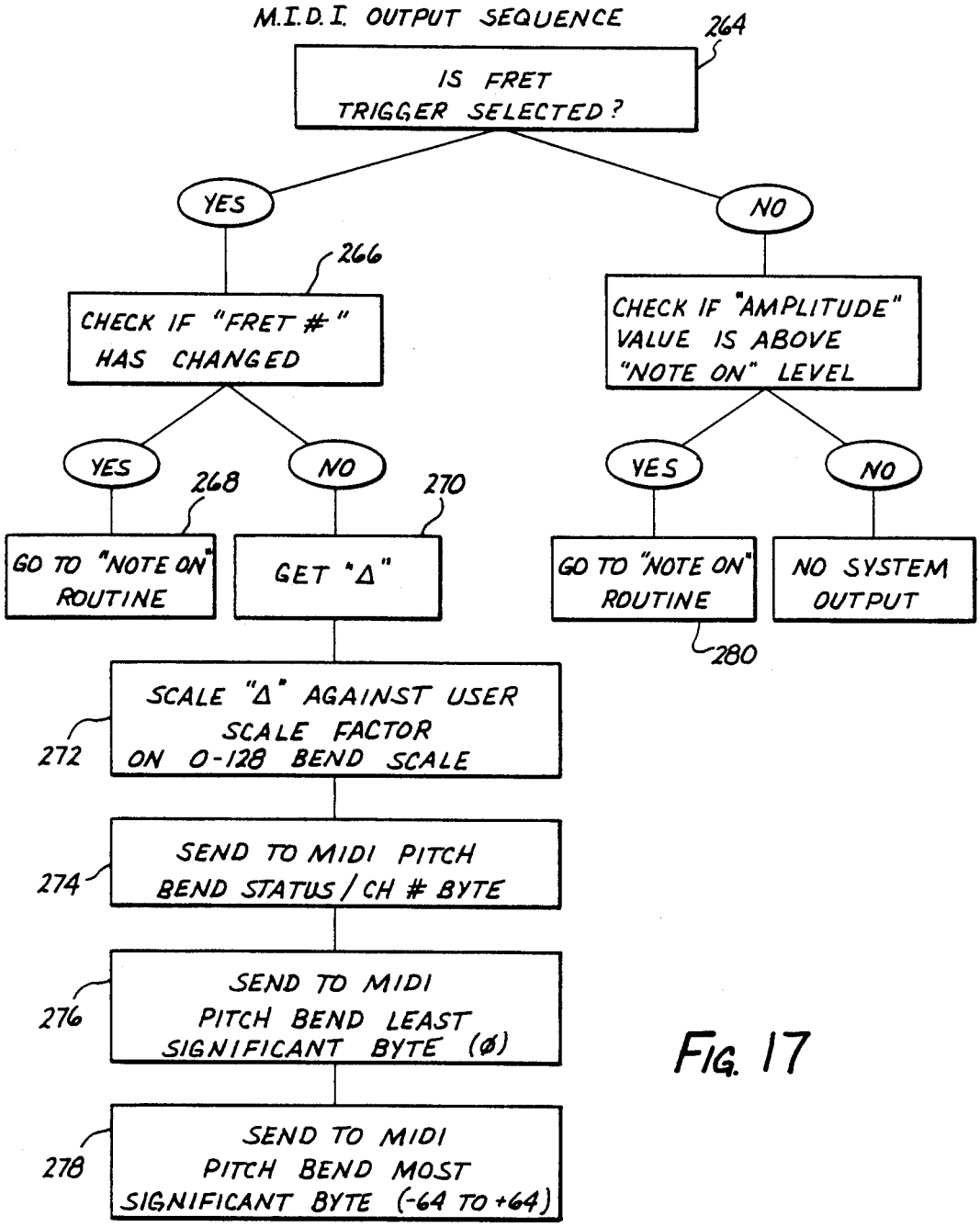
FIG. 17 is the "note on" step sequence for the FIG. 16 sequence.

The string bend information itself is isolated from the time value output of binary counter 110 in a string bend processor sequence illustrated in FIG. 16 and which is executed separately for each string of the instrument. This sequence involves the steps of retrieving the counter "time" value (236) previously stored at step 218, performing (238) a modulus operation on the same which may be arbitrarily a modulus 25, storing (240) the remainder value, which is a value between 0 and 24, as the "current" relative phase value. The previously stored relative phase value called here "delta" is then retrieved (242) by the processor and subtracted (244) from the "current" relative phase value. The result of this subtraction is tested for its sign and if the result is negative, the value 25 is added to it (246), and if positive nothing is added, and the result of this addition or no addition is stored (248) as the "bend up" value. The next step (250) is to subtract "delta" from the "current" relative phase value, and then again test the result for its sign: if the sign is negative, 25 is again added to it, if positive no addition is made (252). The number resulting from the addition or no addition is then stored (254) as the "bend down" value. The stored "bend up"and "bend down" values are then compared (256) for magnitude. If "bend up" is smaller than "bend down" then the new value of "delta" is the previous "delta" plus "bend up" (258); if instead "bend down" is smaller than "bend up" then the new value for "delta" is equal to the previous "delta" minus "bend down" (260). The final step in this sequence is the updating (262) of the stored "delta" value by entering the newly computed value into the appropriate memory space for subsequent retrieval at step 242 when this sequence is repeated for the next system time frame, and also at step 210 for data output to MIDI

M.I.D.I. OUTPUT SEQUENCE

Once the foregoing two sequences have been completed by the processor, the fret number and delta values are available for retrieval at step 210 of the main processor sequence. The note "level" values i.e loudness are directly available from the output of A/D converter 128 and then stored directly in a suitable memory space during each time frame, so that this information is available at step 210 in the main processor sequence. All three data items namely "fret number", note "level" and pitch bend "delta" are outputed in M.I.D.I. format at the following step 212. The M.I.D.I. output sequence comprised within step 212 of the main sequence itself includes the sequence of FIG. 17 comprising the step of first determining (264) the note trigger mode selected by the player through appropriate circuitry, i.e. "normal" triggering by note level or "fret triggering" by merely touching or releasing a string to a particular guitar fret 25. If fret trigger mode is selected the processor makes a comparison (266) of "fret number" derived for the current system time frame against the "fret number" derived for the immediately previous time frame. If the "fret number" has changed, the processor proceeds (268) to a "note on" sequence which will be described below. If no change in fret number has occurred, the "delta" value is then retrieved (270), and is scaled (272) against a scale factor which may be user selectable on a 0 through 128 bend scale. The scaled "delta" value is then encoded by a UART serial communications output subsystem of the microprocessor into M.I.D.I. compatible format which for the delta output data includes transmission of a pitch bend status/channel number bit (274) which alerts the synthesizer to the fact that pitch bend information follows and identifies the pertinent channel number, followed by the pitch bend least significant byte (276), and then followed by the pitch bend most significant byte (278) in the form of a binary number representing the decimal values between minus 64 and plus 64, a bend scale recognizable by most synthesizers.

If it is determined at step 264 that "normal" trigger mode has been selected, a comparison is made of the note "amplitude" value derived from the output of A/D converter 128 against a pres®t "note on level" value which may be user selectable and operates as a sensitivity adjustment below which no output is triggered by the system. If it is determined that the "amplitude" value exceeds the "note on level", the processor proceeds to execute a "note on" sequence which follows.

"NOTE ON" SEQUENCE

Figure 18:
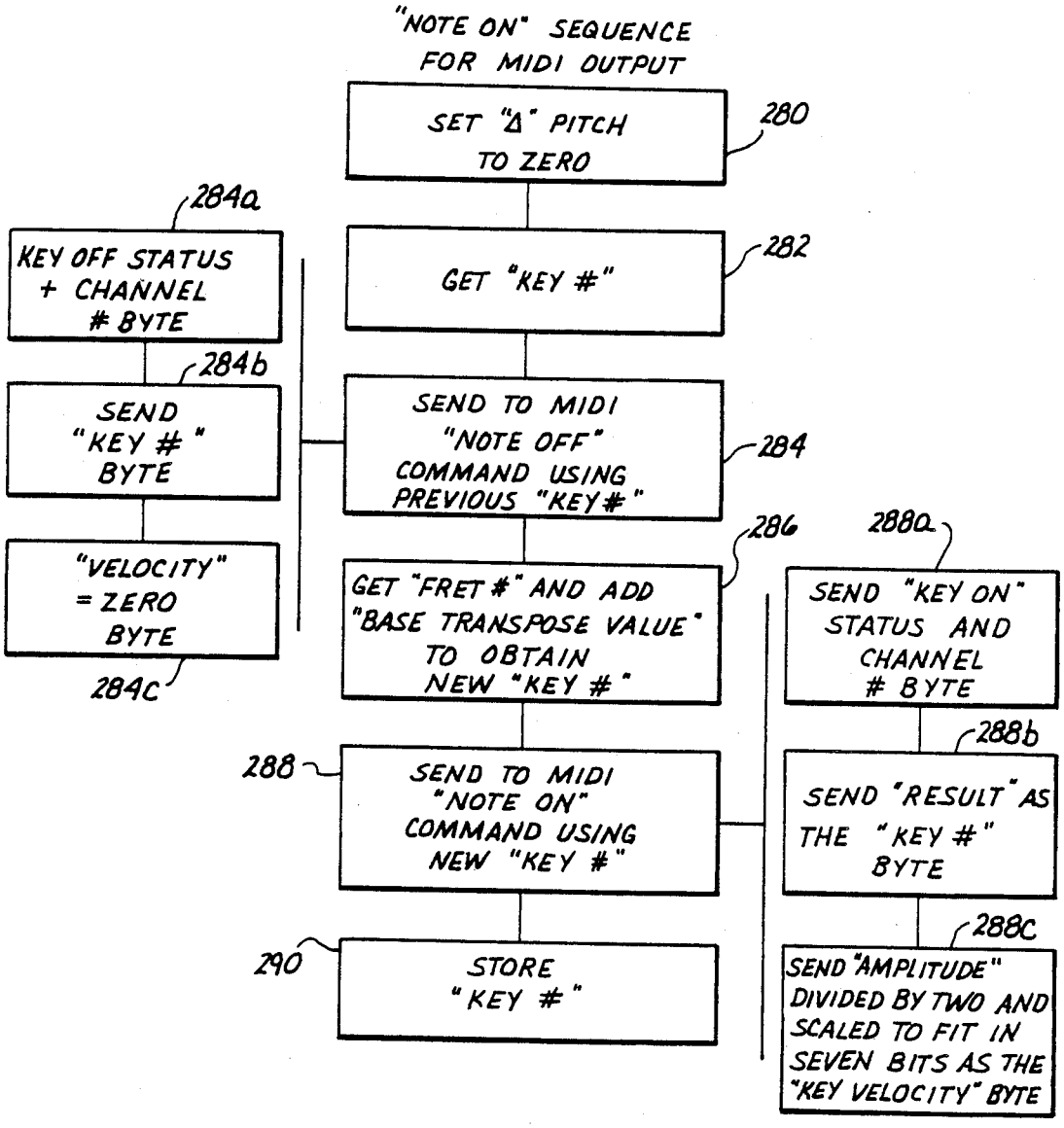
FIG. 18 is the microprocessor step sequence for deriving string bend data in the system of FIG. 11.
Figure 19:
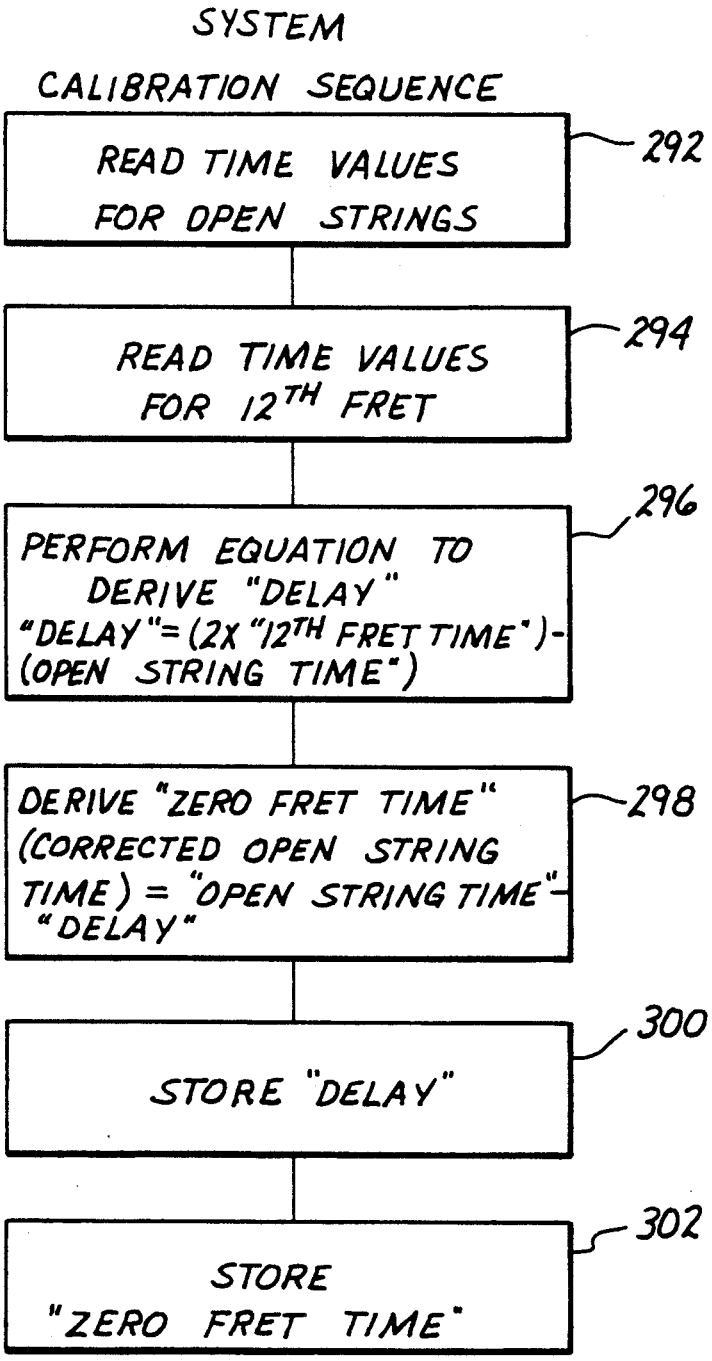
FIG. 19 is a flowchart of a tuning sequence for calibrating the system of FIG. 11 to a particular string instrument.

This sequence illustrated in FIG. 18 commences with the processor resetting (280) the "delta" pitch value to zero, on the assumption that when a new note is played the string is not immediately bent, so that its initial state is taken as a reference zero bend state, and then retrieving (282) a "key number" stored in a previous time frame by a subsequent step of this sequence. The retrieved "key number" is converted (284) to serial digital M.I.D.I. compatible format in the aforementioned UART microprocessor subsystem and transmitted in the form of three consecutive bytes or commands to the synthesizer, the first byte (**284*a*) being a status and channel number byte, followed by a key number byte (284*b*) using the retrieved previous key number and then followed by a zero "velocity" byte, causing the synthesizer to turn off the previous note. The sequence then proceeds to retrieve (286) the "fret number" stored at step 232 of the FIG. 15** sequence and to add to the "fret number" a previously stored "base transpose value" which converts the "fret number" to a "key number" understandable to the synthesizer.

The UART then generates (288) another data stream output to M.I.D.I. in the usual three byte format comprising a first "key on" status and channel number byte (**288*a*) followed by a "key number" byte (288*b*) using the new "key number" and a third byte (288*c*) transmitting the value of "amplitude" divided by two and scaled to fit in seven bytes as the "key velocity" byte. This sequence is completed by updating (290**) the value of "key number" by storing the newly computed key number.

The aforedescribed sequences take place during normal play of the instrument to generate the M.I.D.I. compatible output necessary to drive a synthesizer in accordance with the musical input provided by a performer playing the string instrument, in this case, the guitar 10. It will be noticed from the aforedescribed sequences that the MIDI output for any given system time frame for each string of the instrument will consist of either a "note off" command followed by a "note on" command, or will consist of a pitch bend "delta" command altering the bend of a note already being played by the synthesizer.

During initial setup of the system i.e. installation of the transducer bridge 30 on a particular string instrument or at any time when retuning the strings or other significant adjustment of the instrument is made affecting the acoustic characteristics of the strings or transducer bridge, the following system calibration or tuning sequence is executed.

INSTRUMENT TUNING/SYSTEM CALIBRATION SEQUENCE

The object of this sequence is to derive certain numerical values namely "delay" and "zero fret time" which are called for in the performance of some of the foregoing sequences. These values are constant for the system and once obtained they are stored in memory until such time some change in the acoustic characteristics of the instrument calles for newly calculated values.

This sequence is performed once for each string of the instrument, a total of six times in the guitar of this example. As a first step (292), the processor 120 reads the "time" value for the open instrument string i.e., the string being free from clamping between the bridge 18 and the nut bar 24, which "time" value is then stored. The player is then prompted in a suitable manner by the system to press the twelfth fret 25 and then the processor reads (294) the "time" value for the the twelfth fret of the guitar and stores this second "time" value. The two "time" values thus obtained are used to derive the "delay" value by performing the equation: (2×"twelfth fret time")−("open string time").

A "zero fret time" value which is a an open string time corrected for various lumped time delays attributable to both acoustical and electronic characteristics of the particular instrument is obtained by performing (298) the equation: "zero fret time"="open fret time"−"delay".

The "delay" value is then stored (300) in memory for future use in the performance of other processor sequences during instrument play and the "zero fret time" value is also stored (302) in memory for subsequent retrieval.

It will be understood that the sound pick-up concept here disclosed is broadly applicable to stringed musical instruments and that the guitar system described above is by way of example only, without limitation on the scope of the present invention which is defined only by the following claims.

What is claimed is:

1. A pick-up system for a fretted string instrument comprising:

transmitter means for propagating an ultrasonic test signal of given frequency along each of a plurality of strings;

detector means for detecting an ultrasonic echo signal returned along each of said strings by reflection of said test signal at a point of each of said strings held against a fret and for deriving a peak signal related to said echo signal;

first circuit means connected to said transmitter means and said detector means for deriving a first time interval output measured between said propagation and said peak signal indicative of the musical note obtainable by playing each of said strings; and second circuit means operatively associated with said first circuit means for deriving a second time interval output based on a comparison of said first time interval output and a fret reference value and indicative of the degree of string bending by a player.

2. The system of claim 1 wherein said test signal has a frequency of approximately 40 kilohertz.

3. The system of claim 1 wherein said second output is related to phase shifting of said peak signal induced by string bending.

4. The system of claim 1 further comprising processor means connected for converting said first and second outputs to a MIDI compatible system output containing pitch and string bend information for each said string.

5. The system of claim 1 further comprising third circuit means operatively connected to said detector means and responsive to acoustic vibration of said string in the audible frequency range for deriving a third output indicative of the amplitude of a musical not played on said string.

6. A M.I.D.I. interfaceable guitar comprising:

a guitar having a guitar body, a neck connected at one end to said body and including a head at an opposite end, a string bridge mounted to said body, a plurality of strings stretched between said bridge and said head, and a plurality of frets spaced along said neck;

transmitter means for propagating an ultrasonic test signal from a bridge end along each of said strings;

detector means for detecting an ultrasonic echo signal returned to said bridge end of each said string by reflection of said test signal at a point of each said string clamped against a fret selected by a player and for deriving a peak signal related to said echo signal;

first circuit means connected to said transmitter means and said detector means for deriving a first time interval output indicative of the length of each said string between said bridge and said point and thus indicative of the musical note obtainable by a player touching each said string; and second circuit means associated with said first circuit means for deriving a second time interval output measured between a reference value and said first time interval output and indicative of the degree of bending of each said string by the player.

7. The guitar of claim 6 wherein said transmitter means and said detector means comprise a plurality of piezoelectric transducers, each of said strings being coupled to a single one of said transducers.

8. A method for sensing a note played on a string in a musical string instrument comprising the steps of:

propagating a test signal of given frequency along a string from one end of the string;

detecting a signal returned along said string by reflection of said test signal at an opposite clamped point of said string;

deriving a first time interval measurement output based on the time interval between said test and returned signals indicative of the string length between said one end and said clamped point, said first output thus being representative of the musical note obtainable by playing the string; and detecting a difference between said first time interval measurement and a reference time value, said difference being related to a relative phase shift in said return signal indicative of string bending by a player.

9. The system of claim 8 wherein said test signal is an ultrasonic acoustic signal.

10. The method of claim 8 further comprising the steps of sensing acoustic vibration of said string at audible frequencies for deriving a third output indicative of the amplitude of a musical note played on said string.

11. The method of claim 10 further comprising the step of encoding said first, second and third outputs in standard M.I.D.I. compatible serial digital format.

12. A string bend pick-up system for a fretted string instrument comprising:

transmitter means for propagating a test signal of given frequency along each of a plurality of string;

detector means for detecting an echo signal returned along each said string by reflection of said test signal at a point of the string held against a fret; and circuit means for measuring a time interval between propagation of said test signal and detection of said echo signal, comparing said time interval against a stored table of reference values to identify the fret at which said reflection occurred and for deriving an output related to the difference between said time interval and a reference value associated with the identified fret indicative of the degree of string bending by a player.

13. The system of claim 12 wherein said test signal is an acoustically propagated ultrasonic signal.

14. The system of claim 12 further comprising second circuit means responsive to an interval between said test signal and said echo signal and deriving a second output indicative of said fret.

15. The system of claim 12 further comprising third circuit means responsive to acoustic vibration of each said string in the audible frequency range for deriving a third output indicative of the amplitude of a musical note played on said string.

* * * * *

UNITED STATES PATENT AND TRADEMARK OFFICE

CERTIFICATE OF CORRECTION

PATENT NO.: 4,991,488
DATED : Feb. 12, 1991
INVENTORS : Joseph M. Fala; Mark S. Doerning It is certified that error appears in the above-identified patent and that said Letters Patent is hereby corrected as shown below:

On the title page, Item [76] Inventors:

"Ajay K. Keshap, 14339 Tiara #7, Van Nuys, Calif. 91401"; and "Jay T. Barbeau, 5200 Gary Park Ave." were named erroneously as inventors and their names are hereby deleted from this patent.

On the title page, box [76] Inventors: is to read as follows:

--Joseph M. Fala, 3885 Canfield Rd., Pasadena, Calif. 91006; Mark S. Doerning, 947 Balboa Dr., Arcadia, Calif. 91006--.

Signed and Sealed this

Eighteenth Day of January, 1994

*Attest:*

Bruce Lehman

BRUCE LEHMAN

*Attesting Officer*

*Commissioner of Patents and Trademarks*